US009874839B2

(12) United States Patent
Sawada et al.

(10) Patent No.: US 9,874,839 B2
(45) Date of Patent: Jan. 23, 2018

(54) FIXING DEVICE AND IMAGE FORMING APPARATUS

(71) Applicants: Kazunari Sawada, Tokyo (JP); Kenji Ishii, Kanagawa (JP); Kazuhito Kishi, Kanagawa (JP); Takayuki Seki, Kanagawa (JP); Hiroshi Yoshinaga, Chiba (JP); Takashi Seto, Kanagawa (JP); Hiromasa Takagi, Tokyo (JP); Ippei Fujimoto, Kanagawa (JP); Takamasa Hase, Tokyo (JP); Yasuhiko Ogino, Kanagawa (JP); Shohta Kobashigawa, Tokyo (JP)

(72) Inventors: Kazunari Sawada, Tokyo (JP); Kenji Ishii, Kanagawa (JP); Kazuhito Kishi, Kanagawa (JP); Takayuki Seki, Kanagawa (JP); Hiroshi Yoshinaga, Chiba (JP); Takashi Seto, Kanagawa (JP); Hiromasa Takagi, Tokyo (JP); Ippei Fujimoto, Kanagawa (JP); Takamasa Hase, Tokyo (JP); Yasuhiko Ogino, Kanagawa (JP); Shohta Kobashigawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/178,079

(22) Filed: Jun. 9, 2016

(65) Prior Publication Data

US 2016/0378027 A1 Dec. 29, 2016

(30) Foreign Application Priority Data

Jun. 23, 2015 (JP) ..... 2015-125927
Apr. 26, 2016 (JP) ..... 2016-087902

(51) Int. Cl.
*G03G 15/20* (2006.01)

(52) U.S. Cl.
CPC . *G03G 15/2053* (2013.01); *G03G 2215/2025* (2013.01)

(58) Field of Classification Search
CPC ..... G03G 15/2007; G03G 15/2064
See application file for complete search history.

(56) References Cited

U.S. PATENT DOCUMENTS

2010/0067929 A1 3/2010 Seki
2010/0092220 A1 4/2010 Hasegawa et al.
(Continued)

FOREIGN PATENT DOCUMENTS

JP 2002-072736 3/2002
JP 2007-310220 11/2007
(Continued)

OTHER PUBLICATIONS

U.S. Appl. No. 15/063,755, filed Mar. 8, 2016.
(Continued)

*Primary Examiner* — Gregory H Curran
(74) *Attorney, Agent, or Firm* — Oblon, McClelland, Maier & Neustadt, L.L.P.

(57) ABSTRACT

A fixing device includes a fixing rotator rotatable in a predetermined direction of rotation and a nip formation pad disposed inside the fixing rotator. A pressure rotator presses against the nip formation pad via the fixing rotator to form a fixing nip between the fixing rotator and the pressure rotator. A heat generator is disposed inside the fixing rotator to heat the fixing rotator. A reflector is interposed between the heat generator and the nip formation pad. The reflector includes a reflection face to reflect radiant heat radiated from the heat generator. The reflection face includes a reflection portion disposed opposite the heat generator at various angles. A support is provided separately from the nip formation pad and supports the reflector.

21 Claims, 10 Drawing Sheets

(56) References Cited

U.S. PATENT DOCUMENTS

2010/0092221 A1 4/2010 Shinshi et al.
2010/0202809 A1 8/2010 Shinshi et al.
2010/0290822 A1 11/2010 Hasegawa et al.
2011/0026988 A1 2/2011 Yoshikawa et al.
2011/0044734 A1 2/2011 Shimokawa et al.
2011/0052237 A1 3/2011 Yoshikawa et al.
2011/0052245 A1 3/2011 Shinshi et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0076071 A1 3/2011 Yamaguchi et al.
2011/0085832 A1 4/2011 Hasegawa et al.
2011/0116848 A1 5/2011 Yamaguchi et al.
2011/0129268 A1 6/2011 Ishii et al.
2011/0170917 A1 7/2011 Yoshikawa et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222929 A1 9/2011 Fujimoto et al.
2011/0222931 A1 9/2011 Shinshi et al.
2011/0229200 A1 9/2011 Yamaguchi et al.
2011/0229227 A1 9/2011 Yoshikawa et al.
2011/0229228 A1 9/2011 Yoshikawa et al.
2012/0288308 A1 11/2012 Kobashigawa
2012/0301161 A1 11/2012 Fujimoto
2013/0045032 A1 2/2013 Shimokawa et al.
2013/0164056 A1 6/2013 Imada et al.
2013/0164058 A1 6/2013 Suzuki et al.
2013/0164059 A1 6/2013 Takagi et al.
2013/0170877 A1 7/2013 Yoshiura et al.
2013/0170879 A1 7/2013 Yoshinaga et al.
2013/0170880 A1 7/2013 Gotoh et al.
2013/0177340 A1 7/2013 Kawata et al.
2013/0183070 A1 7/2013 Kawata et al.
2013/0183071 A1 7/2013 Iwaya et al.
2013/0183072 A1 7/2013 Hase et al.
2013/0188977 A1 7/2013 Hase et al.
2013/0188991 A1 7/2013 Kawata et al.
2013/0189005 A1 7/2013 Saito et al.
2013/0189008 A1 7/2013 Ishii et al.
2013/0195477 A1 8/2013 Seshita et al.
2013/0195493 A1 8/2013 Hase et al.
2013/0195523 A1 8/2013 Yamaji et al.
2013/0195524 A1 8/2013 Ishii et al.
2013/0195525 A1 8/2013 Yoshinaga et al.
2013/0202320 A1 8/2013 Hase et al.
2013/0209115 A1 8/2013 Hase et al.
2013/0209119 A1 8/2013 Yuasa et al.
2013/0209120 A1 8/2013 Namekata et al.
2013/0209121 A1 8/2013 Uchitani et al.
2013/0209122 A1 8/2013 Yamashina et al.
2013/0209123 A1 8/2013 Waida et al.
2013/0209124 A1 8/2013 Saito et al.
2013/0209125 A1 8/2013 Uchitani et al.
2013/0209126 A1 8/2013 Seo et al.
2013/0209127 A1 8/2013 Fujimoto et al.
2013/0209128 A1 8/2013 Saito et al.
2013/0209131 A1 8/2013 Uchitani et al.
2013/0209139 A1 8/2013 Ogawa et al.
2013/0209146 A1 8/2013 Yamaji et al.
2013/0209147 A1 8/2013 Ogawa et al.
2013/0236225 A1 9/2013 Ogawa et al.
2013/0251390 A1 9/2013 Ishii et al.
2013/0251422 A1 9/2013 Iwaya et al.
2013/0251430 A1 9/2013 Fujimoto et al.
2013/0266355 A1 10/2013 Yoshiura et al.
2014/0010578 A1 1/2014 Ishigaya et al.
2014/0016971 A1 1/2014 Arai et al.
2014/0016972 A1 1/2014 Seshita et al.
2014/0064804 A1 3/2014 Yamaguchi et al.
2014/0072355 A1 3/2014 Tamaki et al.
2014/0079424 A1 3/2014 Ikebuchi et al.
2014/0079453 A1 3/2014 Arai et al.
2014/0079455 A1 3/2014 Seki et al.
2014/0112691 A1 4/2014 Nanno et al.
2014/0133879 A1 5/2014 Seshita et al.
2014/0241766 A1 8/2014 Ishii et al.
2014/0248072 A1 9/2014 Yoshinaga et al.
2014/0270820 A1 9/2014 Saito et al.
2014/0270822 A1 9/2014 Yamashina et al.
2014/0270831 A1 9/2014 Yoshinaga et al.
2014/0270832 A1 9/2014 Saito et al.
2014/0270833 A1 9/2014 Yuasa et al.
2014/0270834 A1* 9/2014 Seshita ..... G03G 15/2042 399/68
2014/0270872 A1 9/2014 Tamaki et al.
2014/0270875 A1 9/2014 Mimbu et al.
2014/0286684 A1 9/2014 Takagi et al.
2014/0341623 A1 11/2014 Arai et al.
2014/0341624 A1 11/2014 Arai et al.
2014/0341625 A1 11/2014 Imada et al.
2014/0341626 A1 11/2014 Mimbu et al.
2014/0341627 A1 11/2014 Yoshikawa et al.
2014/0356036 A1 12/2014 Shimokawa et al.
2014/0356037 A1 12/2014 Shimokawa et al.
2014/0356038 A1 12/2014 Arai et al.
2014/0369703 A1 12/2014 Hase et al.
2015/0023705 A1 1/2015 Kawata et al.
2015/0055994 A1 2/2015 Shoji et al.
2015/0063884 A1 3/2015 Iwaya et al.
2015/0071661 A1 3/2015 Yamashina et al.
2015/0098738 A1 4/2015 Arai et al.
2015/0107230 A1 4/2015 Uchitani et al.
2015/0110531 A1 4/2015 Takagi et al.
2015/0125193 A1 5/2015 Ishii et al.
2015/0160591 A1 6/2015 Hase et al.
2015/0168897 A1 6/2015 Ogawa et al.
2015/0185671 A1 7/2015 Ikebuchi et al.
2015/0212459 A1 7/2015 Hase et al.
2015/0227095 A1 8/2015 Uchitani et al.
2015/0234329 A1 8/2015 Hase et al.
2015/0261155 A1 9/2015 Yoshiura et al.
2015/0261157 A1 9/2015 Yamano et al.
2015/0268597 A1 9/2015 Arai et al.
2015/0355586 A1 12/2015 Fujimoto et al.
2015/0355587 A1 12/2015 Tada et al.
2015/0378290 A1 12/2015 Kawata et al.
2016/0004197 A1 1/2016 Imada et al.
2016/0054691 A1 2/2016 Hase et al.

FOREIGN PATENT DOCUMENTS

JP 2008-139382 6/2008
JP 2008-197637 8/2008
JP 2010-078839 4/2010
JP 2011-237831 11/2011
JP 2013-164474 8/2013
JP 2014-085499 5/2014

OTHER PUBLICATIONS

U.S. Appl. No. 15/052,450, filed Feb. 24, 2016.
U.S. Appl. No. 15/063,769, filed Mar. 8, 2016.
U.S. Appl. No. 14/966,911, filed Dec. 11, 2015.
U.S. Appl. No. 14/979,686, filed Dec. 28, 2015.
U.S. Appl. No. 14/992,643, filed Jan. 11, 2016.
U.S. Appl. No. 15/011,886, filed Feb. 1, 2016.
U.S. Appl. No. 15/011,982, filed Feb. 1, 2016.

(56) References Cited

OTHER PUBLICATIONS

U.S. Appl. No. 15/013,807, filed Feb. 2, 2016.
U.S. Appl. No. 15/013,827, filed Feb. 2, 2016.
U.S. Appl. No. 15/010,012, filed Jan. 29, 2016.

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2015-125927, filed on Jun. 23, 2015, and 2016-087902 filed on Apr. 26, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a nip formation pad disposed inside the fixing rotator. A pressure rotator presses against the nip formation pad via the fixing rotator to form a fixing nip between the fixing rotator and the pressure rotator. A heat generator is disposed inside the fixing rotator to heat the fixing rotator. A reflector is interposed between the heat generator and the nip formation pad. The reflector includes a reflection face to reflect radiant heat radiated from the heat generator. The reflection face includes a reflection portion disposed opposite the heat generator at various angles. A support is provided separately from the nip formation pad and supports the reflector.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing rotator rotatable in a predetermined direction of rotation and a nip formation pad disposed inside the fixing rotator. A pressure rotator presses against the nip formation pad via the fixing rotator to form a fixing nip between the fixing rotator and the pressure rotator. A heat generator is disposed inside the fixing rotator to heat the fixing rotator. A reflector is interposed between the heat generator and the nip formation pad. The reflector includes a reflection face to reflect radiant heat radiated from the heat generator. The reflection face includes a reflection portion disposed opposite the heat generator at various angles. A support is provided separately from the nip formation pad and supports the reflector.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
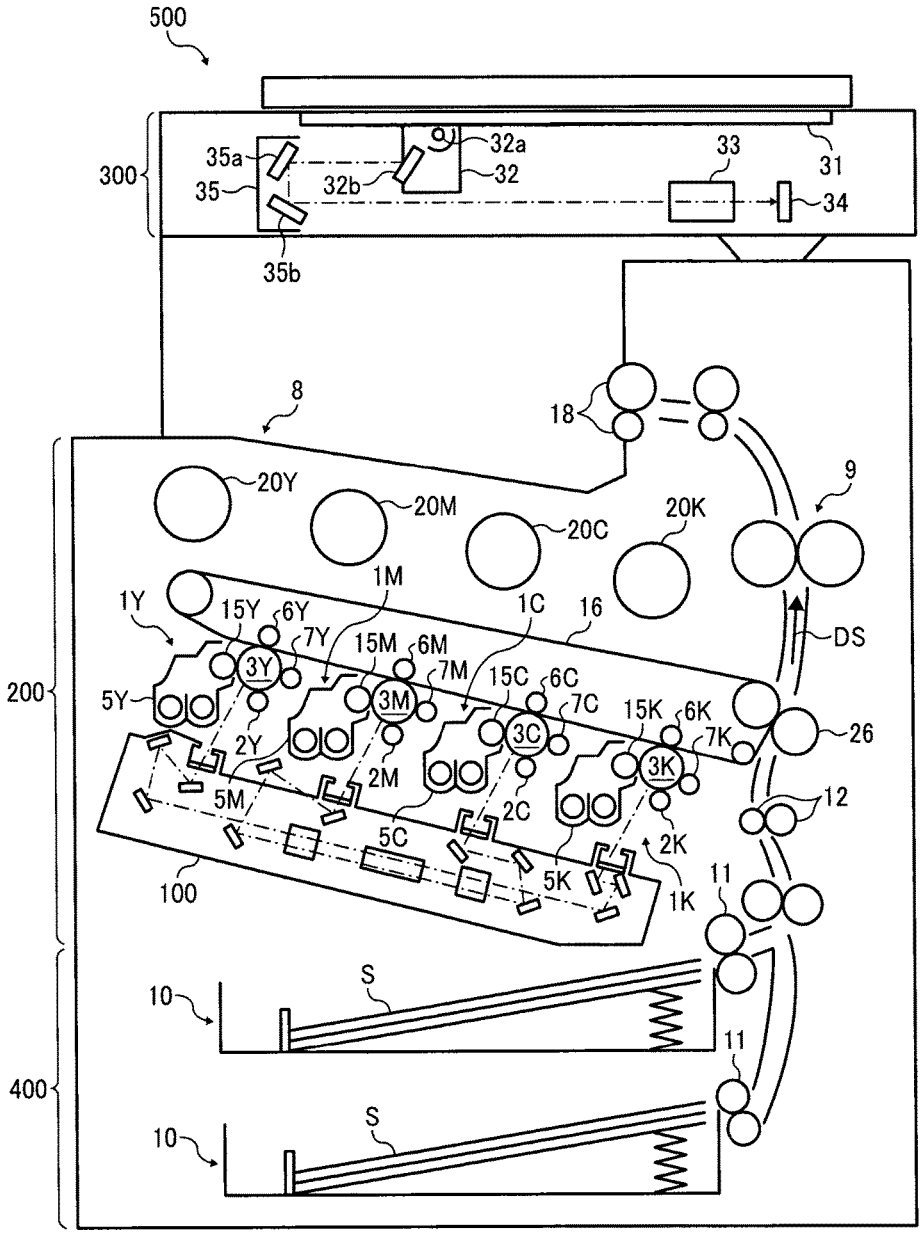
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 500 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 500. The image forming apparatus 500 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 500 is a color copier that forms color and monochrome toner images on a recording medium by electrophotography. Alternatively, the image forming apparatus 500 may be a monochrome copier that forms a monochrome toner image on a recording medium.

Referring to FIG. 1, a description is provided of a construction of the image forming apparatus 500.

As illustrated in FIG. 1, the image forming apparatus 500 includes an image forming section 200, a sheet feeder 400 disposed below the image forming section 200, and a scanner 300 disposed above the image forming section 200.

A detailed description is now given of a construction of the image forming section 200.

The image forming section 200 includes four image forming devices 1Y, 1M, 1C, and 1K that form yellow, magenta, cyan, and black toner images, respectively. Suffixes Y, M, C, and K are assigned to reference numerals of components that are used to form the yellow, magenta, cyan, and black toner images, respectively. Since the four image forming devices 1Y, 1M, 1C, and 1K have a substantially identical construction except for the color of toner used therein, the suffixes Y, M, C, and K indicating the color of toner are omitted as needed.

Each of the image forming devices 1Y, 1M, 1C, and 1K includes a photoconductor 3 (e.g., photoconductors 3Y, 3M, 3C, and 3K) serving as an image bearer or a latent image bearer that bears an electrostatic latent image and a resultant toner image; a charger 2 (e.g., chargers 2Y, 2M, 2C, and 2K) that charges an outer circumferential surface of the photoconductor 3; a developing device 5 (e.g., developing devices 5Y, 5M, 5C, and 5K) that supplies toner to the electrostatic latent image formed on the outer circumferential surface of the photoconductor 3, thus visualizing the electrostatic latent image as a toner image; and a cleaner 7 (e.g., cleaners 7Y, 7M, 7C, and 7K) that cleans the outer circumferential surface of the photoconductor 3.

The image forming section 200 further includes a writing unit 100, an intermediate transfer belt 16, and four primary transfer rollers 6Y, 6M, 6C, and 6K. The writing unit 100 writes an electrostatic latent image on the respective photoconductors 3Y, 3M, 3C, and 3K. The intermediate transfer belt 16 bears yellow, magenta, cyan, and black toner images primarily transferred from the photoconductors 3Y, 3M, 3C, and 3K, respectively. The four primary transfer rollers 6Y, 6M, 6C, and 6K primarily transfer the yellow, magenta, cyan, and black toner images formed on the four photoconductors 3Y, 3M, 3C, and 3K onto the intermediate transfer belt 16, respectively, thus forming a color toner image on the intermediate transfer belt 16. The image forming section 200 further includes a secondary transfer roller 26 and a registration roller pair 12. The secondary transfer roller 26 is disposed opposite the intermediate transfer belt 16 to form a secondary transfer nip therebetween where the secondary transfer roller 26 secondarily transfers the color toner image formed on the intermediate transfer belt 16 onto a transfer sheet S serving as a recording medium. Upstream from the secondary transfer nip in a sheet conveyance direction DS is the registration roller pair 12 that halts the transfer sheet S temporarily.

The image forming section 200 further includes four toner bottles 20Y, 20M, 20C, and 20K containing fresh yellow, magenta, cyan, and black toners to be supplied to the developing devices 5Y, 5M, 5C, and 5K that consume the yellow, magenta, cyan, and black toners, respectively. Downstream from the secondary transfer roller 26 in the sheet conveyance direction DS, that is, above the secondary transfer roller 26 in FIG. 1, is a fixing device 9. Downstream from the fixing device 9 in the sheet conveyance direction DS is an output roller pair 18.

A detailed description is now given of a construction of the sheet feeder 400.

The sheet feeder 400 includes a paper tray 10 that contains a plurality of transfer sheets S and a feed roller 11. The paper tray 10 includes a load plate that loads the plurality of transfer sheets S. The feed roller 11 separates an uppermost transfer sheet S from other transfer sheets S placed on the paper tray 10 and feeds the uppermost transfer sheet S to the registration roller pair 12.

A detailed description is now given of a construction of the scanner 300.

The scanner 300 includes an exposure glass 31 on which an original is placed. The scanner 300 further includes components that scan the original placed on the exposure glass 31. For example, the scanner 300 includes a first carriage 32 and a second carriage 35. The first carriage 32 mounts a light source 32*a* that emits light to irradiate the original and a first mirror 32*b*. The second carriage 35 mounts a second mirror 35*a* and a third mirror 35*b*. The scanner 300 further includes a lens 33 and a charge-coupled device (CCD) 34, that is, a CCD image sensor, disposed behind the lens 33.

A description is provided of an image forming operation performed by the image forming apparatus 500.

As a user places an original on the exposure glass 31 and starts an image forming operation, the light source 32*a* irradiates the original through the exposure glass 31 with light. Reflection light reflected by the original is reflected by the first mirror 32*b*, the second mirror 35*a*, and the third mirror 35*b*. The lens 33 forms the light into an image that enters the CCD 34. The scanner 300 creates image data based on the light entered into the CCD 34 so that the image forming section 200 forms a toner image on a transfer sheet S according to the image data.

In the image forming section 200, the charger 2 uniformly charges the outer circumferential surface of the photoconductor 3 while the photoconductor 3 rotates. The writing unit 100 is driven according to the image data. A light source of the writing unit 100 emits light according to the image data. The light irradiates and scans the uniformly charged outer circumferential surface of the photoconductor 3, forming an electrostatic latent image on the photoconductor 3. A developing roller 15 (e.g., developing rollers 15Y, 15M, 15C, and 15K) of the developing device 5 supplies developer (e.g., toner) to the electrostatic latent image to develop the electrostatic latent image into a visible toner image.

While the toner image is formed on the photoconductor 3, the feed roller 11 picks up a transfer sheet S from one of the plurality of paper trays 10 that is selected and feeds the transfer sheet S to the registration roller pair 12. As a leading edge of the transfer sheet S comes into contact with a nip formed by the registration roller pair 12, the registration roller pair 12 halts the transfer sheet S. The four primary transfer rollers 6Y, 6M, 6C, and 6K primarily transfer yellow, magenta, cyan, and black toner images formed on the photoconductors 3Y, 3M, 3C, and 3K onto the intermediate transfer belt 16 at four primary transfer nips formed between the photoconductors 3Y, 3M, 3C, and 3K and the intermediate transfer belt 16, respectively, such that the yellow, magenta, cyan, and black toner images are superimposed on a same position on the intermediate transfer belt 16 to form a color toner image thereon. The registration roller pair 12 resumes rotation to convey the transfer sheet S to the secondary transfer nip at a time when the color toner image formed on intermediate transfer belt 16 reaches the secondary transfer nip. As the transfer sheet S transferred with the color toner image at the secondary transfer nip comes into contact with a discharging brush, the transfer sheet S is discharged by the discharging brush. After the transfer sheet S is mechanically separated from the intermediate transfer belt 16, the transfer sheet S is conveyed to the fixing device 9.

The fixing device 9 fixes the color toner image on the transfer sheet S under heat and pressure. The transfer sheet S bearing the fixed toner image is ejected by the output roller pair 18 onto an output tray 8. After the primary transfer of the yellow, magenta, cyan, and black toner images from the photoconductors 3Y, 3M, 3C, and 3K onto the intermediate transfer belt 16, the cleaners 7Y, 7M, 7C, and 7K remove residual toner failed to be transferred onto the intermediate transfer belt 16 and therefore remaining on the outer circumferential surface of the respective photoconductors 3Y, 3M, 3C, and 3K therefrom. The removed toner is collected into a waste toner container. A discharger discharges the outer circumferential surface of the respective photoconductors 3Y, 3M, 3C, and 3K, rendering the photoconductors 3Y 3M, 3C, and 3K to be ready for a next image forming operation.

The above describes the image forming operation in which the scanner 300 reads the image on the original into image data and the image forming section 200 forms the color toner image according to the image data. Alternatively, the image forming apparatus 500 may form a toner image according to image data sent from an external electronic device such as a client computer.

The image forming apparatus 500 employs an intermediate transfer method for transferring a toner image formed on the photoconductor 3 onto a transfer sheet S via the intermediate transfer belt 16 serving as an intermediate transferor. Alternatively, the image forming apparatus 500 may employ a direct transfer method for transferring a toner image formed on the photoconductor 3 onto a transfer sheet S directly.

Figure 2:
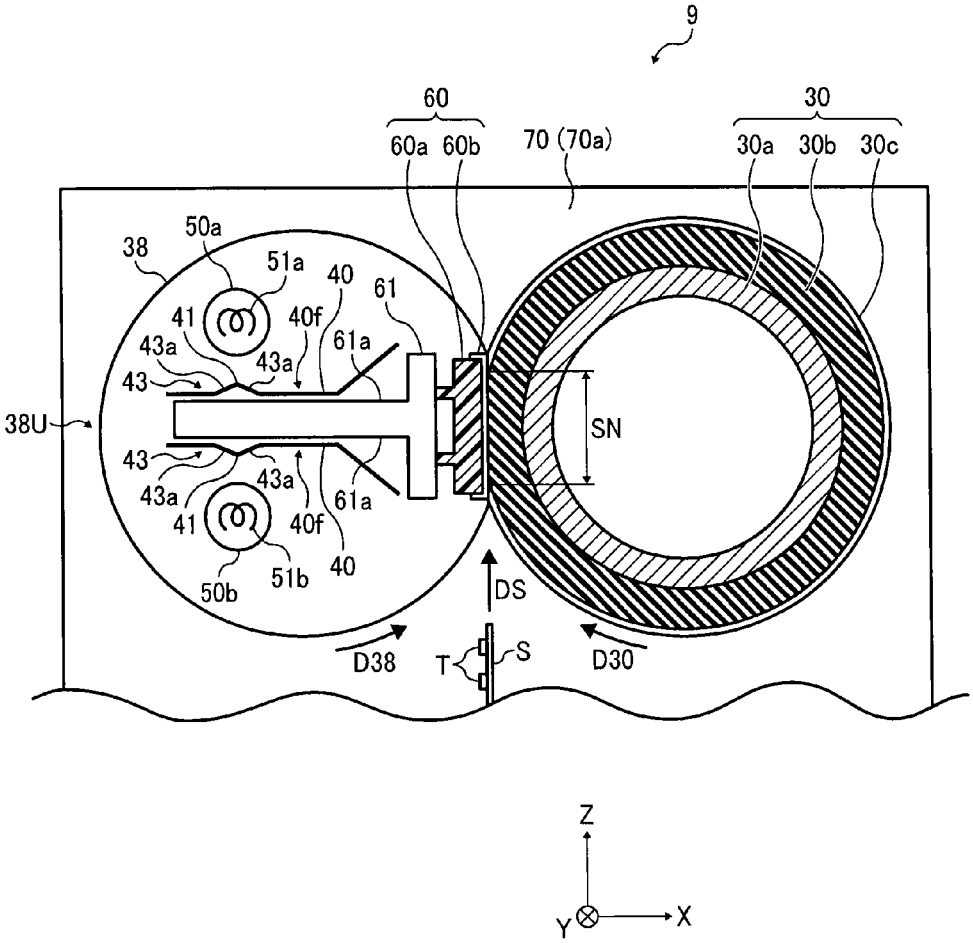
FIG. 2 is a schematic vertical cross-sectional view of a fixing device incorporated in the image forming apparatus illustrated in FIG. 1.

Referring to FIG. 2, a description is provided of a construction of the fixing device 9 incorporated in the image forming apparatus 500 having the construction described above.

FIG. 2 is a schematic vertical cross-sectional view of the fixing device 9. As illustrated in FIG. 2, the fixing device 9 includes a substantially tubular fixing belt 38 serving as a fixing rotator or a fixing member rotatable in a rotation direction D38 and a pressure roller 30, serving as a pressure rotator, a contact rotator, or a contact member rotatable in a rotation direction D30, to come into contact with the fixing belt 38 to drive the fixing belt 38. Alternatively, the fixing belt 38 may be driven and rotated by a driver coupled with the fixing belt 38. Inside a loop formed by the fixing belt 38 are a pressure pad 60 and a stay 61 that serve as a nip formation pad and a first halogen heater 50*a* and a second halogen heater 50*b* that serve as a plurality of heat generators.

As illustrated in FIG. 2, the first halogen heater 50*a* is disposed opposite the second halogen heater 50*b* vertically via the stay 61. A reflector 40 is interposed between the stay 61 and each of the first halogen heater 50*a* and the second halogen heater 50*b* to reflect radiant heat or light radiated from the first halogen heater 50*a* and the second halogen heater 50*b* toward an inner circumferential surface of the fixing belt 38.

A supporting side plate 70 is disposed at each lateral end of the fixing device 9 in a longitudinal direction thereof parallel to an axial direction of the fixing belt 38. The supporting side plate 70 constitutes a part of a frame of the image forming apparatus 500 that supports the components of the fixing device 9 described above. The fixing belt 38 and the components situated inside the loop formed by the fixing belt 38, that is, the reflector 40, the first halogen heater 50*a*, the second halogen heater 50*b*, the pressure pad 60, and the stay 61, may constitute a belt unit 38U separably coupled with the pressure roller 30.

A detailed description is now given of a construction of the fixing belt 38.

The fixing belt 38 is a tubular heating rotator that is flexibly deformable. The fixing belt 38 is constructed of a base layer, an elastic layer coating the base layer, and a release layer coating the elastic layer. The tubular fixing belt 38 has an outer diameter of 30 mm. The base layer made of nickel (Ni) has a thickness in a range of from 10 micrometers to 70 micrometers. The elastic layer made of silicone rubber has a thickness in a range of from 50 micrometers to 150 micrometers. The release layer serving as an outermost layer of the fixing belt 38 has a thickness in a range of from 5 micrometers to 50 micrometers and is made of fluoroplastic to enhance durability of the fixing belt 38 and facilitate separation of toner of a toner image T on a transfer sheet S from the fixing belt 38. The fluoroplastic of the release layer is tetrafluoroethylene-perfluoroalkylvinylether copolymer (PFA), polytetrafluoroethylene (PTFE), or the like. Alternatively, the release layer may be made of other fluoroplastic. Further, the base layer of the fixing belt 38 may be made of a material other than nickel, for example, metal such as SUS stainless steel or heat resistant resin such as polyimide (PI).

A detailed description is now given of a construction of the pressure roller 30.

The pressure roller 30, having an outer diameter of 30 mm, is constructed of a hollow cored bar 30*a* made of iron, an elastic layer 30*b* coating the cored bar 30*a*, and a release layer 30*c* coating the elastic layer 30*b*. The elastic layer 30*b*, made of silicone rubber, has a thickness of 5 mm. The fluoroplastic release layer 30*c* having a thickness of about 40 micrometers may coat the elastic layer 30*b* to facilitate separation of a foreign substance (e.g., paper dust and toner) from the pressure roller 30. A pressurization assembly biases and presses the pressure roller 30 against the fixing belt 38 to form a fixing nip SN between the pressure roller 30 and the fixing belt 38.

A detailed description is now given of a construction of the pressure pad 60.

The pressure pad 60 is constructed of a resin portion 60*a* and a thermal equalizer 60*b*. The resin portion 60*a* is made of heat resistant resin such as liquid crystal polymer (LCP). The thermal equalizer 60*b*, made of copper, coats the resin portion 60*a*. As the inner circumferential surface of the fixing belt 38 slides over the thermal equalizer 60*b*, the thermal equalizer 60*b* equalizes a temperature distribution of the fixing belt 38 in the axial direction thereof. The pressure pad 60 presses against the pressure roller 30 via the fixing belt 38 to form the fixing nip SN between the fixing belt 38 and the pressure roller 30.

A detailed description is now given of a configuration of the stay 61.

The pressure pad 60 is mounted on and supported by the stay 61. Each lateral end of the stay 61 in a longitudinal direction thereof parallel to the axial direction of the fixing belt 38 is supported by the supporting side plate 70. The stay 61 receives pressure exerted from the pressure roller 30 to the pressure pad 60, thus serving as a reinforcement that contacts an interior face of the pressure pad 60 and supports the pressure pad 60 against pressure from the pressure roller 30 to allow the pressure pad 60 to form the fixing nip SN between the fixing belt 38 and the pressure roller 30.

A detailed description is now given of a construction of the first halogen heater 50*a* and the second halogen heater 50*b*.

The first halogen heater 50*a* is disposed opposite the second halogen heater 50*b* vertically in FIG. 2 via the stay 61. A heater holder disposed outboard from the supporting side plate 70 in the longitudinal direction of the fixing device 9 supports each lateral end of each of the first halogen heater 50*a* and the second halogen heater 50*b* in a longitudinal direction thereof parallel to the axial direction of the fixing belt 38. The first halogen heater 50*a* includes a first luminous filament 51*a* spanning a decreased span in the longitudinal direction of the first halogen heater 50*a*. The decreased span corresponds to a width of a small transfer sheet S in a width direction thereof parallel to the longitudinal direction of the first halogen heater 50*a*. The second halogen heater 50*b* includes a second luminous filament 51*b* disposed outboard from the decreased span of the first luminous filament 51*a* in the longitudinal direction of the second halogen heater 50*b*. The first luminous filament 51*a* and the second luminous filament 51*b* span an increased span in the longitudinal direction of the second halogen heater 50*b*. The increased span corresponds to a width of a large transfer sheet S in a width direction thereof parallel to the longitudinal direction of the second halogen heater 50*b*.

A detailed description is now given of a construction of the reflector 40.

The reflector 40 is interposed between the stay 61 and each of the first halogen heater 50*a* and the second halogen heater 50*b*. Thus, the stay 61 is disposed opposite each of the first halogen heater 50*a* and the second halogen heater 50*b* via the reflector 40. Each lateral end of the reflector 40 in a longitudinal direction thereof parallel to the axial direction of the fixing belt 38 is supported by the supporting side plate 70. The reflector 40 is constructed of an aluminum base and a silver paste layer coating the base. The reflector 40 includes a reflection face 40*f* that reflects heat or light radiated from the first halogen heater 50*a* and the second halogen heater 50*b* to the fixing belt 38. The reflector 40 is a plate bent at a plurality of spots to shield the stay 61 and the pressure pad 60 from the first halogen heater 50*a* and the second halogen heater 50*b*. Thus, the reflection face 40*f* of the reflector 40 is bent at various angles in a reflection portion of the reflection face 40*f* that is disposed opposite the first halogen heater 50*a* and the second halogen heater 50*b*.

The reflector 40 further includes a projection 43 serving as a reflection portion. The projection 43 has a summit 41 situated at an intersection where the reflection face 40*f* intersects a perpendicular defined by the reflection face 40*f* and a center (e.g., an axis) in a direction perpendicular to the axial direction of the fixing belt 38 of each of the first halogen heater 50*a* and the second halogen heater 50*b*. Radiant heat or light emitted from each of the first halogen heater 50*a* and the second halogen heater 50*b* and directed to the reflection face 40*f* in an incident direction along the perpendicular irradiates slopes 43*a* of the projection 43. Since the incident direction of the radiant heat or light is not perpendicular to the slopes 43*a* of the projection 43, the radiant heat or light is reflected by the projection 43 in a reflection direction different from the incident direction. Accordingly, the reflection face 40*f* reflects the radiant heat or light irradiating the reflection face 40*f* toward the fixing belt 38, not toward the first halogen heater 50*a* and the second halogen heater 50*b*, preventing the radiant heat or light from penetrating through the first halogen heater 50*a* and the second halogen heater 50*b* and preventing the reflected heat or light from heating the first halogen heater 50*a* and the second halogen heater 50*b*.

A description is provided of a construction of a comparative fixing device.

Image forming apparatuses such as a copier, a printer, a facsimile machine, and a multifunction peripheral or a multifunction printer form a toner image on an image bearer (e.g., a photoconductor) according to image data. The toner image is transferred onto a recording medium such as paper and overhead projector (OHP) transparencies. While the recording medium bearing the toner image is conveyed through the comparative fixing device, the comparative fixing device fixes the toner image on the recording medium under heat and pressure.

The comparative fixing device is requested to heat a heating member (e.g., a fixing belt) to a desired fixing temperature quickly and thereby shorten a waiting time (e.g., a warm-up time) for a user to wait until a print job starts and save energy. To address this request to shorten the waiting time and save energy, the comparative fixing device may include a thin belt, a thin film, or a thin roller that is heated by a halogen heater directly.

For example, the comparative fixing device includes a rotatable, tubular fixing belt, a pressure roller contacting an outer circumferential surface of the fixing belt, and a heat generator disposed inside a loop formed by the fixing belt to heat the fixing belt.

A nip formation pad disposed inside the loop formed by the fixing belt presses against the pressure roller via the fixing belt to form a fixing nip between the fixing belt and the pressure roller. The nip formation pad includes a pressure pad (e.g., a guide) over which an inner circumferential surface of the fixing belt slides and a platy reinforcement projecting from the pressure pad toward an interior of the loop formed by the fixing belt. The reinforcement is interposed between a plurality of heat generators (e.g., a plurality of heaters). A reflector is mounted on each side face of the reinforcement that is disposed opposite the heat generator. The reflector reflects radiant heat or light radiated from the heat generator toward the fixing belt. The reflector includes a projection (e.g., a gable) projecting toward the heat generator and having a summit disposed opposite the heat generator.

The radiant heat or light radiated from the heat generator irradiates a slope of the projection of the reflector. The slope of the projection reflects the radiant heat or light. An incidence angle of the radiant heat or light that irradiates the slope of the projection is not perpendicular to the slope of the projection. Accordingly, the reflector reflects the radiant heat or light in a reflection direction different from an incident direction of the radiant heat or light. Consequently, the reflector prevents the reflected heat or light from being directed to and heating the heat generator, improving heating efficiency of heating the fixing belt.

The comparative fixing device includes the endless fixing belt having a thermal capacity smaller than a thermal capacity of a heating roller or a fixing roller. The pressure pad and the reinforcement supporting the pressure pad are disposed inside the loop formed by the fixing belt. Thus, the comparative fixing device shortens the waiting time and saves energy. As the image forming apparatus incorporating the comparative fixing device is downsized, the fixing belt incorporated in the comparative fixing device is downsized to have a decreased loop diameter that reduces an interval between the heat generator and the reinforcement and an interval between the heat generator and the reflector that are disposed inside the loop formed by the fixing belt. As the interval between the heat generator and the reflector decreases, an amount of radiant heat radiated from the heat generator that is reflected by the reflector and passed through the heat generator increases, degrading heating efficiency of heating the fixing belt.

If the thickness of the reflector decreases to secure a sufficient interval between the heat generator and the reflector, the rigidity of the reflector decreases. Accordingly, the reflector may be bent in a longitudinal direction thereof due to its weight. In order to prevent the reflector from being bent, the reflector may be secured to or molded with the reinforcement.

Alternatively, the reinforcement may be interposed between a plurality of halogen heaters disposed inside the loop formed by the fixing belt to prevent the plurality of halogen heaters from heating each other. A reflection face of the reflector mounted on the reinforcement may have the projection projecting toward the halogen heater at a position where the reflection face is disposed opposite the halogen heater, that is, at an intersection where a perpendicular defined by a center of the halogen heater and the reflection face intersects the reflection face. Accordingly, the reflection face prevents radiant heat or light emitted from the halogen heater from irradiating the reflector substantially perpendicularly, thus preventing the radiant heat or light from being reflected by the reflector and heating the halogen heater. Consequently, the radiant hear or light reflected by the reflector heats the fixing belt.

The intersection where the perpendicular intersects the reflection face corresponds to or overlaps the summit of the projection precisely to prevent the radiant heat or light radiated from the halogen heater from irradiating the reflector substantially perpendicularly, thus preventing the radiant heat or light reflected by the reflector from heating the halogen heater.

In the comparative fixing device incorporating the endless fixing belt that has the decreased thermal capacity and the pressure pad and the reinforcement that are situated inside the loop formed by the fixing belt, the pressure roller situated outside the loop formed by the fixing belt is pressed against the pressure pad via the fixing belt to form the fixing nip between the pressure roller and the fixing belt. The pressure pad and the reinforcement are exerted with pressure from the pressure roller throughout the entire width of the pressure pad and the reinforcement in a longitudinal direction thereof. Accordingly, the pressure pad and the reinforcement are bent in the longitudinal direction thereof. As the reinforcement is bent, the reflector mounted on the reinforcement is also bent, deviating the summit of the projection of the reflector from the center of the halogen heater and resulting in failure in improving heating efficiency of heating the fixing belt.

The reflector is molded with the reinforcement of the nip formation pad pressing against the pressure roller via the fixing belt. The nip formation pad situated inside the loop formed by the fixing belt is secured to the comparative fixing device at each lateral end of the comparative fixing device in an axial direction of the fixing belt. Accordingly, the nip formation pad may be bent toward the interior of the loop formed by the fixing belt by pressure from the pressure roller. Consequently, the reflector molded with the reinforcement of the nip formation pad may be deformed in accordance with bending of the reinforcement. The summit of the projection (e.g., the gable) of the reflector may deviate from the heat generator in a direction in which the reinforcement projects from the pressure pad. The deviated projection may fail to heat the fixing belt effectively.

Such failure may also occur if the reflection face of the reflector is contoured into shapes other than the gable to direct the radiant heat or light from the heat generator in the reflection direction different from the incident direction of the radiant heat or light. For example, the failure may occur with the reflector including a curved projection, a recess having a slope tilted relative to the incident direction of the radiant heat or light, or other reflection portions that reflect the radiant heat or light in the reflection direction different from the incident direction. The failure may also occur if the comparative fixing device includes the heat generator disposed opposite one side face of the reinforcement, instead of the plurality of heat generators disposed opposite both side faces of the reinforcement, respectively.

The reinforcement may be upsized to achieve an increased rigidity great enough to prevent bending. However, since the reinforcement is situated inside the loop formed by the fixing belt, it is difficult to upsize the reinforcement. To address this circumstance, the shape of the pressure pad and the reinforcement may be determined in view of allowable slight bending.

A description is provided of a construction of a comparative fixing device 9C.

Figure 3:
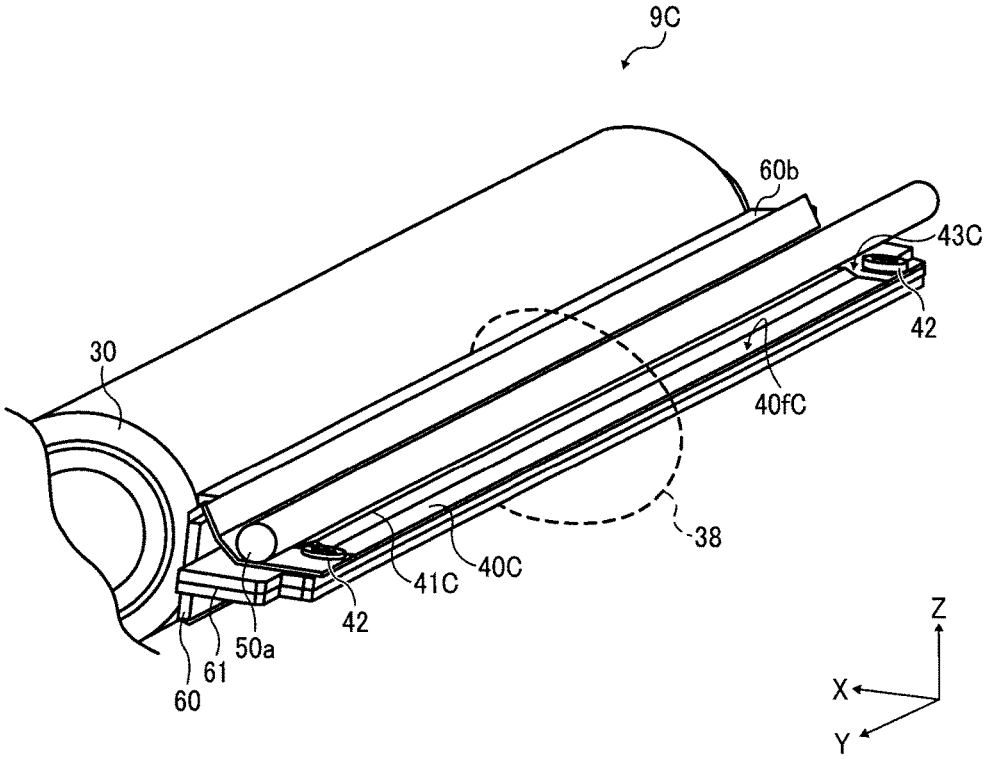
FIG. 3 is a perspective view of a comparative fixing device.
Figure 4A:
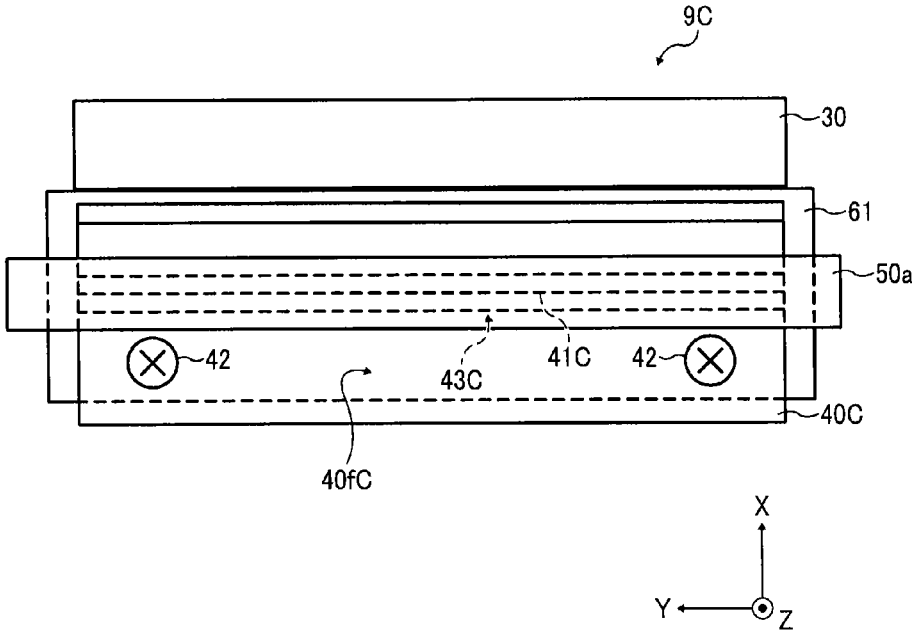
FIG. 4A is a schematic top view of the comparative fixing device depicted in FIG. 3 illustrating a depressurization state in which a pressure roller is not pressed against a fixing belt.
Figure 4B:
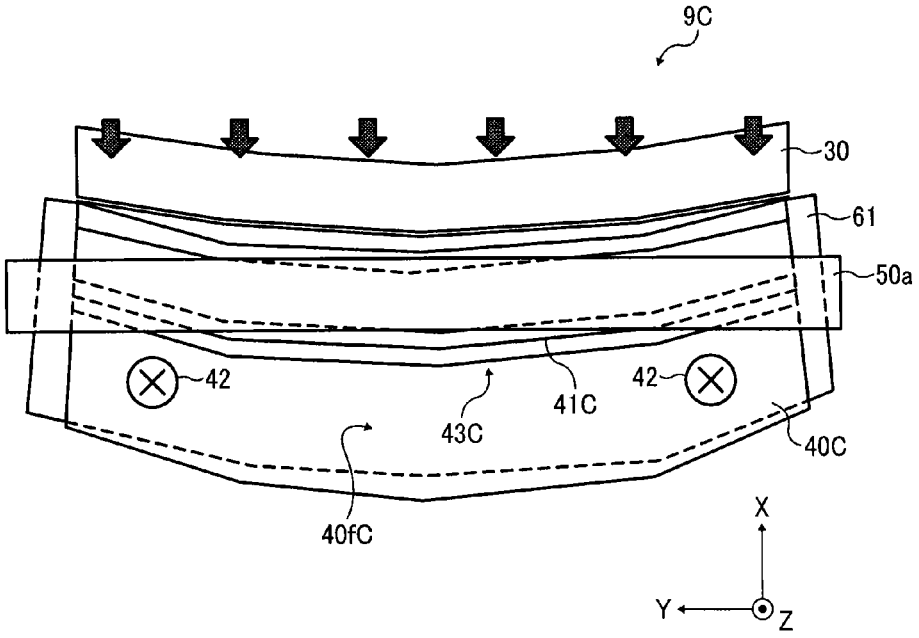
FIG. 4B is a schematic top view of the comparative fixing device depicted in FIG. 3 illustrating a pressurization state in which the pressure roller is pressed against the fixing belt.

FIG. 3 is a perspective view of the comparative fixing device 9C. As illustrated in FIG. 3, the comparative fixing device 9C includes a reflector 40C secured to the stay 61, unlike the fixing device 9 depicted in FIG. 2 including the reflector 40 secured to the supporting side plates 70. FIG. 3 illustrates the comparative fixing device 9C from which the fixing belt 38 is removed. FIG. 3 illustrates a trajectory of the fixing belt 38 in a dotted line. FIGS. 4A and 4B illustrate a schematic top view of the comparative fixing device 9C illustrating a top of the comparative fixing device 9C depicted in FIG. 3. FIG. 4A illustrates a depressurization state in which the pressure roller 30 is not pressed against the fixing belt 38. FIG. 4B illustrates a pressurization state in which the pressure roller 30 is pressed against the fixing belt 38.

As illustrated in FIG. 3, the comparative fixing device 9C includes the reflector 40C supported by the stay 61. The reflector 40C is fastened to the stay 61 with a plurality of screws 42 at both lateral ends of the stay 61 in the longitudinal direction thereof (e.g., a direction Y in FIG. 3). As illustrated in FIG. 4A, in the depressurization state, a summit 41C of a projection 43C of the reflector 40C corresponds to or overlaps the center of the first halogen heater 50*a* in a direction X perpendicular to the longitudinal direction of the stay 61. That is, the summit 41C of the projection 43C of the reflector 40C is disposed opposite the center of the first halogen heater 50*a*.

As the pressurization assembly biases and presses the pressure roller 30 against the fixing belt 38 in the pressurization state, the stay 61 is exerted with pressure from the pressure roller 30 through the fixing belt 38 and the pressure pad 60. As the stay 61 is exerted with pressure, the stay 61 is deformed and bent such that a center portion of the stay 61 in the longitudinal direction thereof separates away from the pressure roller 30 as illustrated in FIG. 4B.

As the reflector 40C deforms in accordance with deformation of the stay 61, the summit 41C of the projection 43C is displaced such that a center portion of the summit 41C in a longitudinal direction of the reflector 40C separates away from the pressure roller 30. Accordingly, the summit 41C of the projection 43C of the reflector 40C deviates substantially from the center of the first halogen heater 50*a* in the direction X. Consequently, a reflection face 40*f*C of the reflector 40C may not reflect radiant heat or light irradiating the reflection face 40*f*C toward the fixing belt 38 without directing the radiant heat or light to the first halogen heater 50*a*, degrading heating efficiency of heating the fixing belt 38. Although failures of the comparative fixing device 9C are described above with reference to the first halogen heater 50*a*, similar failures may occur with the second halogen heater 50*b* disposed opposite the first halogen heater 50*a* via the stay 61.

A description is provided of a configuration of the fixing device 9 to address the failures of the comparative fixing device 9C.

Figure 5:
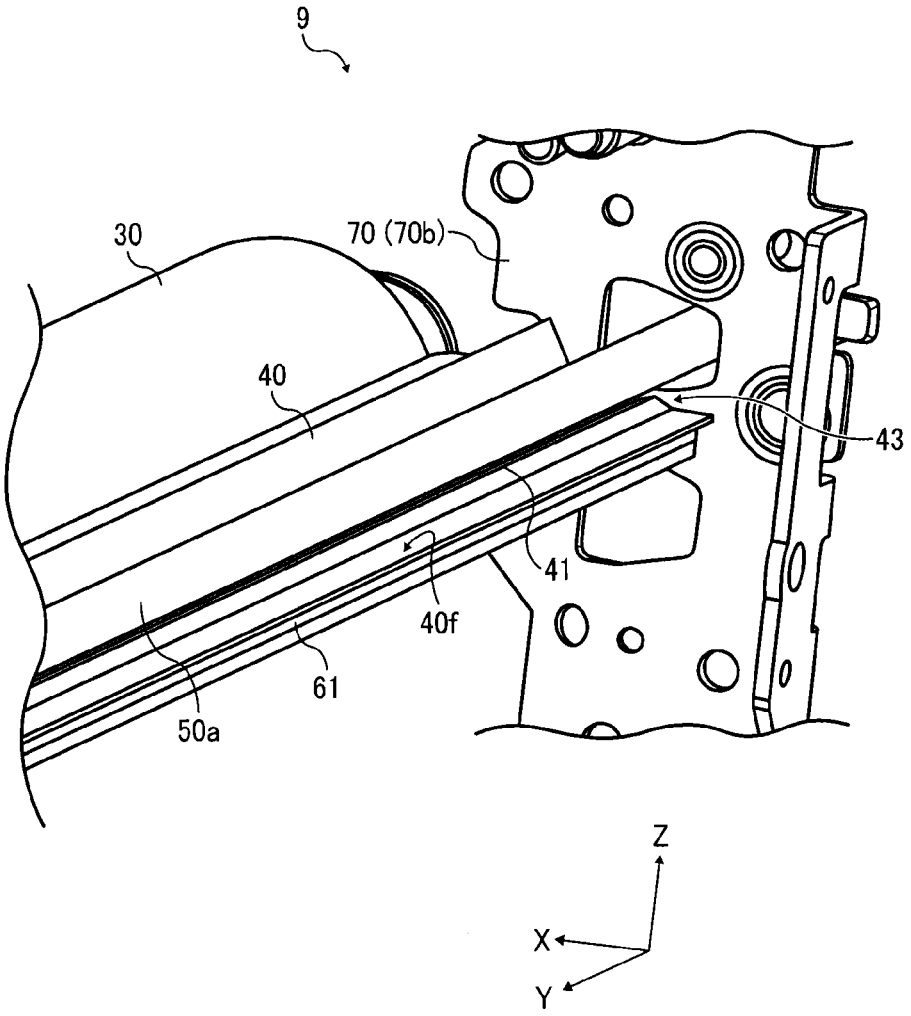
FIG. 5 is a partial perspective view of the fixing device depicted in FIG. 2 illustrating a reflector.
Figure 6A:
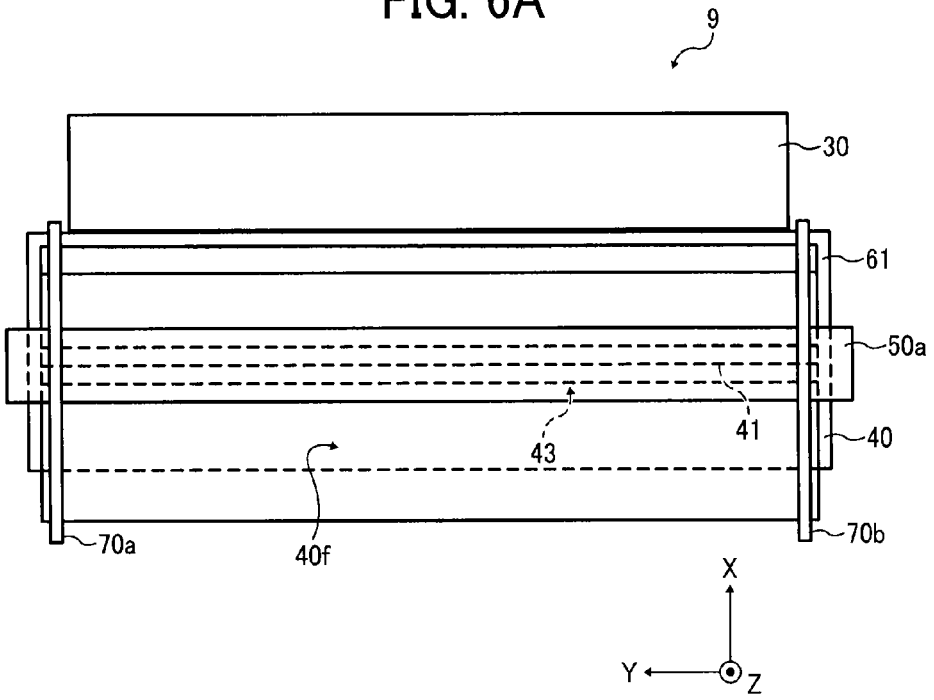
FIG. 6A is a schematic top view of the fixing device depicted in FIG. 5 illustrating the depressurization state in which the pressure roller is not pressed against the fixing belt.
Figure 6B:
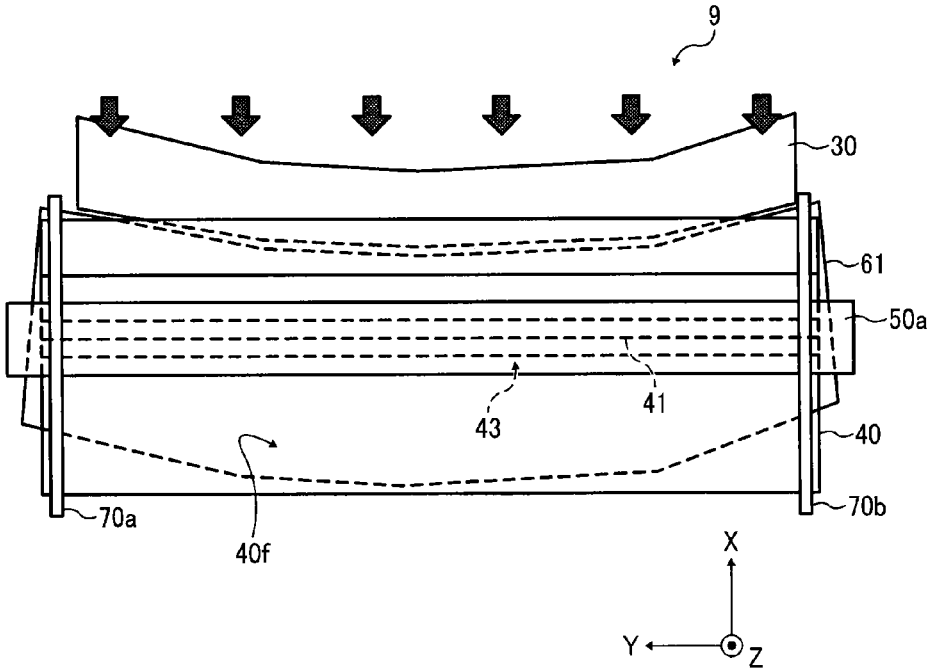
FIG. 6B is a schematic top view of the fixing device depicted in FIG. 5 illustrating the pressurization state in which the pressure roller is pressed against the fixing belt.

FIG. 5 is a partial perspective view of the fixing device 9. FIG. 5 illustrates the fixing device 9 from which the fixing belt 38 is removed. FIGS. 6A and 6B illustrate a schematic top view of the fixing device 9 illustrating a top of the fixing device 9 depicted in FIG. 5. FIG. 6A illustrates the depressurization state in which the pressure roller 30 is not pressed against the fixing belt 38. FIG. 6B illustrates the pressurization state in which the pressure roller 30 is pressed against the fixing belt 38.

As illustrated in FIG. 5, the fixing device 9 includes the reflector 40 supported by the supporting side plates 70. As illustrated in FIGS. 6A and 6B, both lateral ends of the reflector 40 in the longitudinal direction thereof are inserted into the two supporting side plates 70, that is, a rear supporting side plate 70*a* and a front supporting side plate 70*b*, respectively, to secure the reflector 40 to the supporting side plates 70. Each lateral end of the reflector 40 in the longitudinal direction spans a length in a range of from 5 mm to 8 mm. As illustrated in FIG. 6A, in the depressurization state, the summit 41 of the projection 43 of the reflector 40 corresponds to or overlaps the center, that is, the axis, of the first halogen heater 50*a* in the direction X perpendicular to the longitudinal direction of the reflector 40. That is, the summit 41 of the projection 43 of the reflector 40 is disposed opposite the center of the first halogen heater 50*a*.

The stay 61 is also secured to the supporting side plates 70. Each lateral end of the stay 61 in the longitudinal direction thereof that spans a length in a range of from 5 mm to 8 mm is inserted into the supporting side plate 70 at a position below the reflector 40 inserted into the supporting side plate 70 by 1 mm to secure the stay 61 to the supporting side plate 70.

As the pressurization assembly biases and presses the pressure roller 30 against the fixing belt 38 in the pressurization state, the stay 61 is exerted with pressure from the pressure roller 30 through the fixing belt 38 and the pressure pad 60. As the stay 61 is exerted with pressure, the stay 61 is deformed and bent such that the center portion of the stay 61 in the longitudinal direction thereof separates away from the pressure roller 30 as illustrated in FIG. 6B.

Since the reflector 40 of the fixing device 9 is not secured to the stay 61 and is supported by the two supporting side plates 70 (e.g., the rear supporting side plate 70*a* and the front supporting side plate 70*b*), the reflector 40 does not deform in accordance with deformation of the pressure pad 60 and the stay 61. Accordingly, even in the depressurization state, the summit 41 of the projection 43 of the reflector 40 does not deviate from the center of the first halogen heater 50*a* in the direction X. Hence, the summit 41 of the projection 43 of the reflector 40 retains a precise position with respect to the center of the first halogen heater 50*a* in the direction X.

Consequently, radiant heat or light radiated from the first halogen heater 50*a* does not irradiate the reflection face 40*f* of the reflector 40 substantially perpendicularly. The reflection face 40*f* of the reflector 40 constantly reflects the radiant heat or light toward the fixing belt 38 without directing the radiant heat or light to the first halogen heater 50*a*, thus preventing the radiant heat or light from penetrating through the first halogen heater 50*a* and the second halogen heater 50*b* and retaining heating efficiency of heating the fixing belt 38. The fixing device 9 retaining heating efficiency of heating the fixing belt 38 allows the entire image forming apparatus 500 to decrease energy consumption, saving energy.

The stay 61 is also secured to the supporting side plates 70 to prevent deformation of the reflector 40 in accordance with bending of the stay 61 while suppressing increase in the number of parts of the fixing device 9. As illustrated in FIG. 2, the stay 61 and the reflector 40 are interposed between the plurality of halogen heaters, that is, the first halogen heater 50*a* and the second halogen heater 50*b*, to prevent the plurality of halogen heaters from heating each other.

A description is provided of a variation of the fixing device 9.

Figure 7:
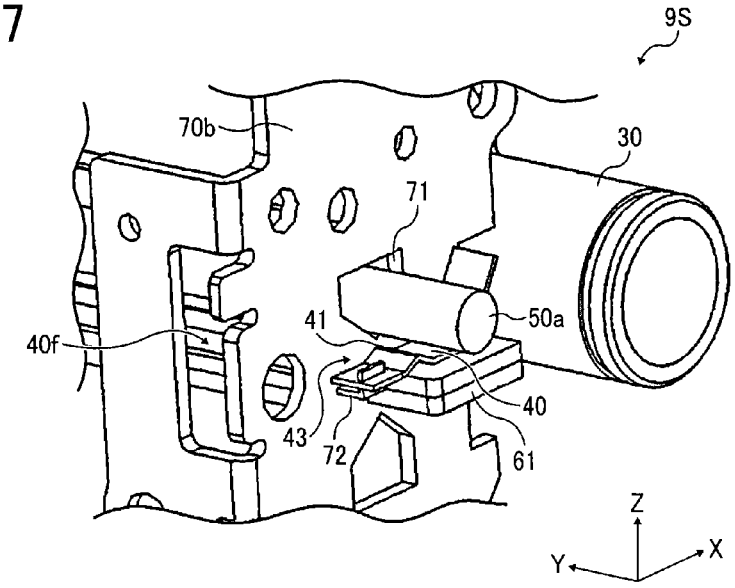
FIG. 7 is a partial perspective view of a fixing device as a variation of the fixing device depicted in FIG. 2.
Figure 8:
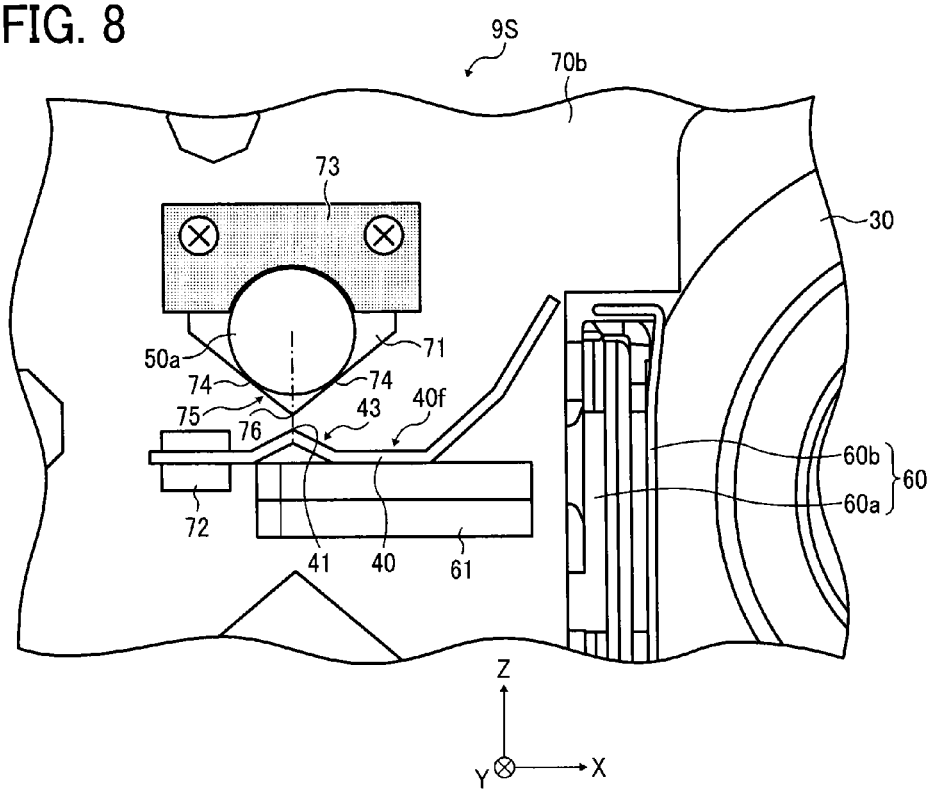
FIG. 8 is a side view of the fixing device depicted in FIG. 7.
Figure 9:
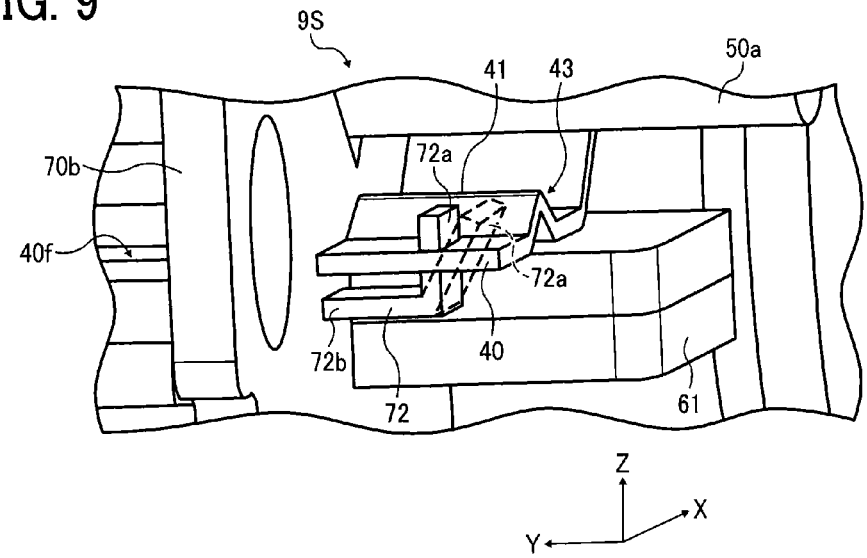
FIG. 9 is an enlarged perspective view of the fixing device seen from an angle different from an angle of FIG. 7.

FIG. 7 is a partial perspective view of a fixing device 9S as a variation of the fixing device 9 depicted in FIG. 2. FIG. 8 is a side view of the fixing device 9S. FIG. 9 is an enlarged perspective view of the fixing device 9S seen from an angle different from an angle of FIG. 7. FIGS. 7 to 9 illustrate the fixing device 9S from which the fixing belt 38, the second halogen heater 50*b*, and the reflector 40 disposed opposite the second halogen heater 50*b* are removed.

As illustrated in FIG. 7, the fixing device 9S includes the stay 61, the reflector 40, and the first halogen heater 50*a* that are supported by the front supporting side plate 70*b* collectively. The front supporting side plate 70*b* includes a pentagonal slot 71 into which the first halogen heater 50*a* is inserted. As illustrated in FIG. 8, the pentagonal slot 71 includes two slopes 74 constituting a V-shaped portion 75 disposed opposite and projected downward toward the projection 43 of the reflector 40. The V-shaped portion 75 bears the first halogen heater 50*a*. A heater lock 73 presses the first halogen heater 50*a* down against the V-shaped portion 75. Thus, the first halogen heater 50*a* contacts the slot 71 and the heater lock 73 at three spots. For example, the first halogen heater 50*a* contacts the two slopes 74 of the slot 71 and the heater lock 73, being secured to the slot 71.

A summit 76 of the V-shaped portion 75 of the slot 71 that projects downward in FIG. 8 corresponds to or overlaps the summit 41 of the projection 43 of the reflector 40 inserted into a slot of the front supporting side plate 70*b* in the direction X. That is, the summit 76 of the V-shaped portion 75 of the slot 71 is disposed opposite the summit 41 of the projection 43 of the reflector 40. Hence, the summit 41 of the projection 43 of the reflector 40 is positioned with respect to the center of the first halogen heater 50*a* in the direction X precisely.

Referring to FIG. 9, a description is provided of a configuration of the reflector 40 and a flat spring 72 biased against the reflector 40.

The flat spring 72 is bent at a substantially right angle to define an L-shape. One end, that is, a first end 72*b*, of the flat spring 72 is press-fitted into and secured to the front supporting side plate 70*b*. Another end, that is, a second end 72*a*, of the flat spring 72 is inserted into the reflector 40. The flat spring 72 in a natural state is widened in a direction Y to define an obtuse angle as illustrated as the flat spring 72 in a dotted line in FIG. 9. The second end 72*a* of the flat spring 72 is press-fitted into the reflector 40 such that the flat spring 72 is bent at the substantially right angle. Accordingly, the reflector 40 is exerted with a force to recover the natural state of the flat spring 72. Although FIGS. 7 to 9 illustrate the flat spring 72 inserted into the front supporting side plate 70*b*, the flat spring 72 is also inserted into the rear supporting side plate 70*a* similarly such that the flat spring 72 is bent at the substantially right angle. Accordingly, the reflector 40 is exerted with a force to recover the natural state of the two flat springs 72 such that the force stretches the reflector 40 in the longitudinal direction thereof, preventing the reflector 40 from being bent in the longitudinal direction of the reflector 40 by its weight.

A description is provided of variations of the reflector 40.

Figure 10:
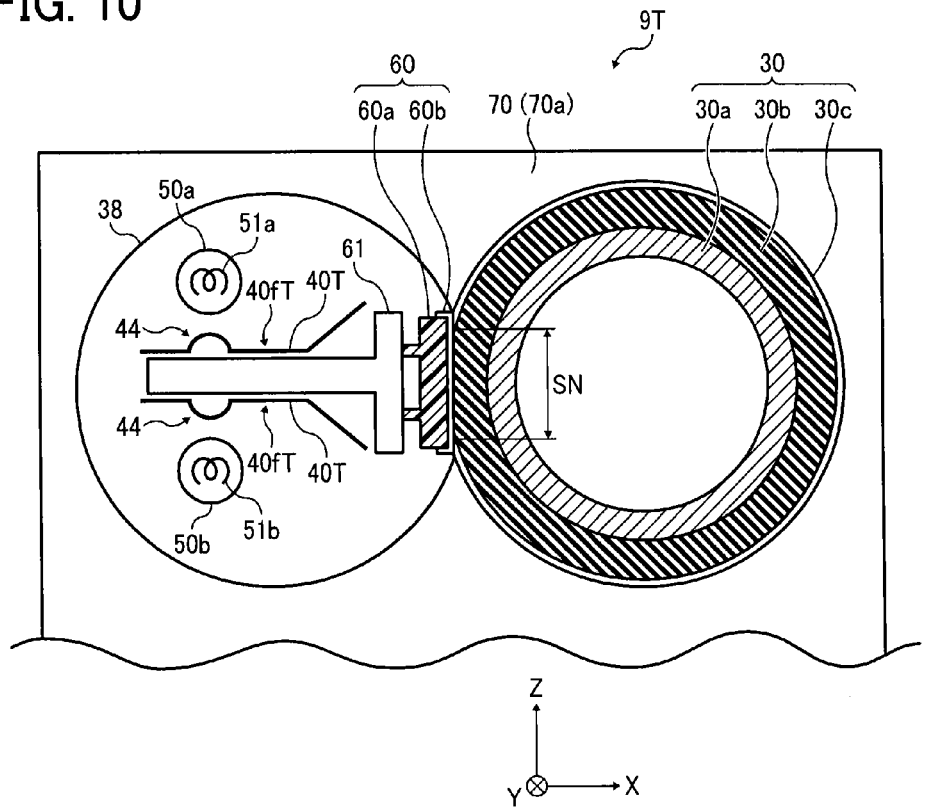
FIG. 10 is a schematic vertical cross-sectional view of a fixing device incorporating a reflector as a first variation of the reflector depicted in FIG. 5.
Figure 11:
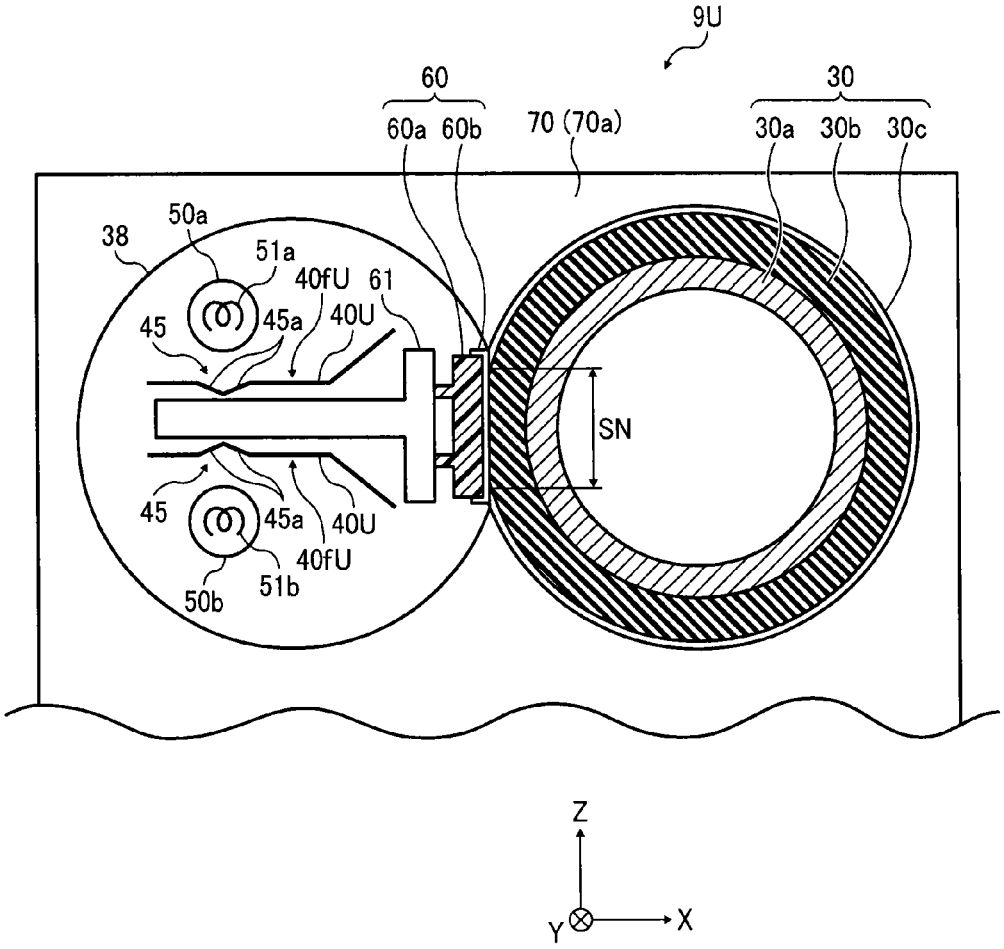
FIG. 11 is a schematic vertical cross-sectional view of a fixing device incorporating a reflector as a second variation of the reflector depicted in FIG. 5.
Figure 12:
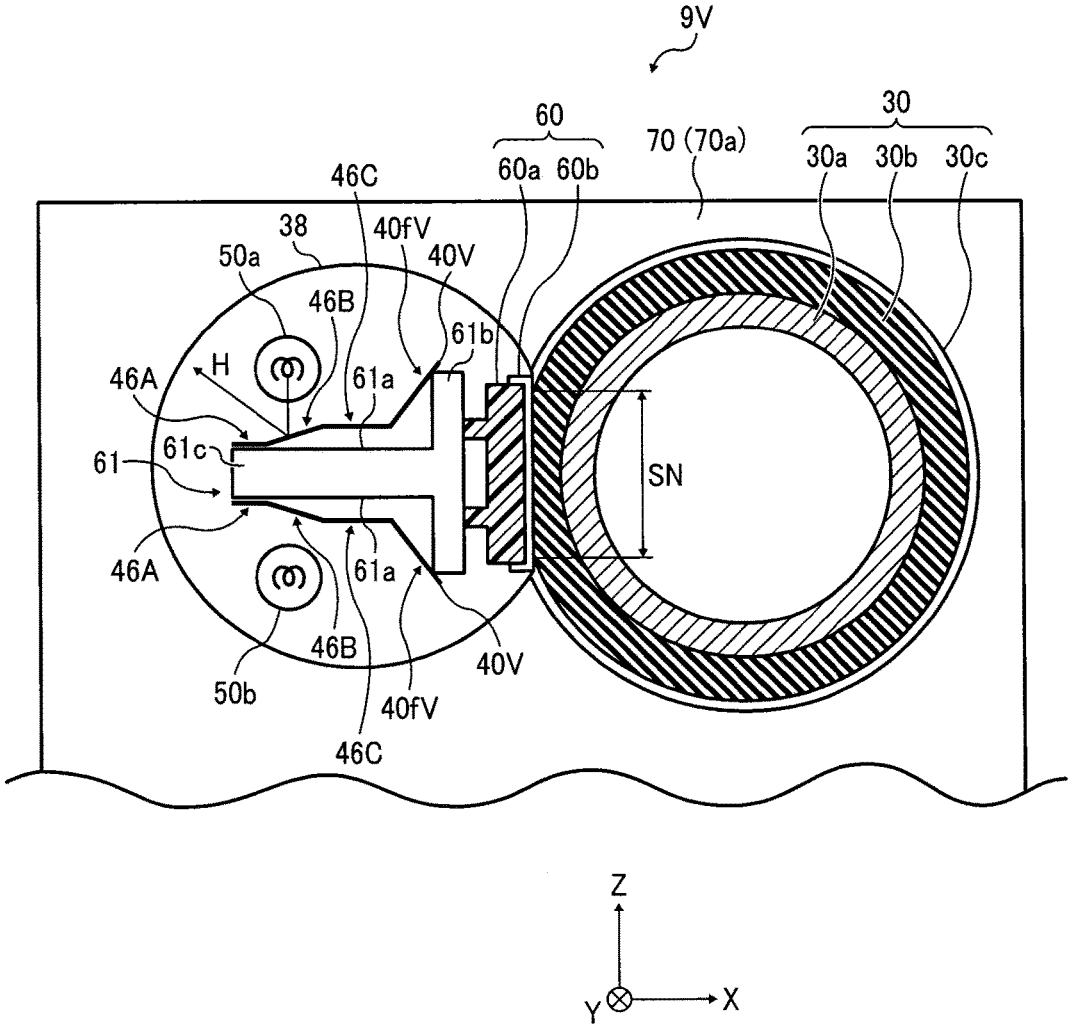
FIG. 12 is a schematic vertical cross-sectional view of a fixing device incorporating a reflector as a third variation of the reflector depicted in FIG. 5.

FIG. 10 is a schematic vertical cross-sectional view of a fixing device 9T incorporating a reflector 40T as a first variation of the reflector 40. FIG. 11 is a schematic vertical cross-sectional view of a fixing device 9U incorporating a reflector 40U as a second variation of the reflector 40. FIG. 12 is a schematic vertical cross-sectional view of a fixing device 9V incorporating a reflector 40V as a third variation of the reflector 40.

Instead of the reflection face 40*f* of the reflector 40, the reflectors 40T and 40U include reflection faces 40*f*T and 40*f*U, respectively, each of which has a shape, other than the gable of the projection 43 depicted in FIG. 2, to reflect radiant heat or light radiated from the first halogen heater 50*a* and the second halogen heater 50*b* in the reflection direction different from the incident direction of the radiant heat or light. Since the reflectors 40T and 40U share a common configuration with the reflector 40 except for the shape of an opposed portion of the reflectors 40T and 40U that is disposed opposite each of the first halogen heater 50*a* and the second halogen heater 50*b*, the following describes a configuration of the opposed portion of the reflectors 40T and 40U.

A detailed description is now given of a configuration of the reflector 40T.

As illustrated in FIG. 10, the reflector 40T of the fixing device 9T includes an arch 44 disposed opposite and bulged toward each of the first halogen heater 50*a* and the second halogen heater 50*b*. An outer circumferential surface of the arch 44 is perpendicular to the incident direction of radiant heat or light radiated from the first halogen heater 50*a* and the second halogen heater 50*b* in a limited area on the outer circumferential surface of the arch 44. Accordingly, the outer circumferential surface of the arch 44 reflects the radiant heat or light radiated from the first halogen heater 50*a* and the second halogen heater 50*b* in the reflection direction different from the incident direction of the radiant heat or light in an area other than the limited area on the outer circumferential surface of the arch 44. Consequently, similarly with the reflection face 40*f* of the reflector 40 incorporated in the fixing device 9, the reflection face 40*f*T reflects the radiant heat or light irradiating the reflection face 40*f*T toward the fixing belt 38, not toward the first halogen heater 50*a* and the second halogen heater 50*b*, preventing the radiant heat or light from penetrating through the first halogen heater 50*a* and the second halogen heater 50*b*.

A detailed description is now given of a configuration of the reflector 40U.

As illustrated in FIG. 11, the reflector 40U of the fixing device 9U includes a recess 45 disposed opposite and recessed with respect to each of the first halogen heater 50*a* and the second halogen heater 50*b*. Since the incident direction of radiant heat or light radiated from the first halogen heater 50*a* and the second halogen heater 50*b* is not perpendicular to slopes 45*a* of the recess 45, the radiant heat or light is reflected by the recess 45 in the reflection direction different from the incident direction. Consequently, similarly with the reflection face 40*f* of the reflector 40 incorporated in the fixing device 9, the reflection face 40*f*U reflects the radiant heat or light irradiating the reflection face 40*f*U toward the fixing belt 38, not toward the first halogen heater 50*a* and the second halogen heater 50*b*, preventing the radiant heat or light from penetrating through the first halogen heater 50*a* and the second halogen heater 50*b*. If the two slopes 45*a* define a right angle, the slopes 45*a* may reflect radiant heat or light radiated from the first halogen heater 50*a* and the second halogen heater 50*b* in the incident direction of the radiant heat or light. To address this circumstance, it is preferable that the two slopes 45*a* do not define the right angle.

A detailed description is now given of a configuration of the reflector 40V.

As illustrated in FIG. 12, the reflector 40V of the fixing device 9V includes a reflection face 40*f*V including two planes, that is, a first plane 46A, a second plane 46C, and a third plane 46B, that reflect heat or light radiated from the first halogen heater 50*a* and the second halogen heater 50*b* in the reflection direction different from the incident direction of the heat or light and not direct the heat or light back to the first halogen heater 50*a* and the second halogen heater 50*b*. Each of the first plane 46A and the second plane 46C is parallel to the side face 61*a* of the stay 61. The second plane 46C is stepped with respect to the first plane 46A. The third plane 46B bridges the first plane 46A and the second plane 46C.

Since the fixing device 9V has a construction equivalent to the construction of the fixing device 9 depicted in FIG. 2 except for the shape of the reflector 40V, the following describes a difference between the fixing device 9 and the fixing device 9V.

The stay 61 includes a base 61*b* and an arm 61*c* projecting from the base 61*b* to support the pressure pad 60 against pressure from the pressure roller 30. The two reflectors 40V cover the arm 61*c*. Each of the reflectors 40V includes the two parallel planes, that is, the first plane 46A and the second plane 46C, which are parallel to the arm 61*c*. The second plane 46C is stepped with respect to the first plane 46A. The third plane 46B serving as a tilt plane bridges the first plane 46A and the second plane 46C.

Each of the first halogen heater 50*a* and the second halogen heater 50*b* is disposed opposite the third plane 46B. An incidence angle of heat or light irradiating the third plane 46B is not perpendicular to the third plane 46B. Accordingly, the third plane 46B reflects the heat or light in the reflection direction different from the incident direction of the heat or light, preventing the heat or light reflected by the third plane 46B from being directed to the first halogen heater 50*a* and the second halogen heater 50*b*. For example, heat or light radiated from the first halogen heater 50*a* and irradiating the third plane 46B is reflected by the third plane 46B in a direction H. Thus, the reflected heat or light does not return to the first halogen heater 50*a* and is directed to a portion of the fixing belt 38 that is opposite the pressure pad 60 via the stay 61. Accordingly, the reflected heat or light does not heat a glass tube and the like of the first halogen heater 50*a*, heating the fixing belt 38 effectively. Similarly, heat or light radiated from the second halogen heater 50*b* and irradiating the third plane 46B is reflected by the third plane 46B toward the fixing belt 38, not toward the second halogen heater 50*b*.

As illustrated in FIG. 1, the image forming apparatus 500 employs a vertical conveyance system to convey the transfer sheet S vertically upward. Accordingly, as illustrated in FIG. 2, the fixing belt 38 and the pressure roller 30 are aligned horizontally. Alternatively, the image forming apparatus 500 may employ a horizontal conveyance system to convey the transfer sheet S horizontally. In this case, the fixing device 9 is rotated by 90 degrees so that the fixing belt 38 and the pressure roller 30 are aligned vertically.

The exemplary embodiments described above are one example and attain advantages below in a plurality of aspects A to I.

A description is provided of advantages of the fixing devices 9, 9S, 9T, 9U, and 9V in an aspect A.

As illustrated in FIGS. 9, 9S, 9T, 9U, and 9V, a fixing device (e.g., the fixing devices 9, 9S, 9T, 9U, and 9V) includes a fixing rotator or an endless rotator (e.g., the fixing belt 38), a pressure rotator or a contact member (e.g., the pressure roller 30), a nip formation pad (e.g., the pressure pad 60 and the stay 61), a heat generator (e.g., the first halogen heater 50*a* and the second halogen heater 50*b*), a reflector (e.g., the reflectors 40, 40T, 40U, and 40V), and a support (e.g., the supporting side plates 70). The fixing rotator is rotatable in a predetermined direction of rotation (e.g., the rotation direction D38). The pressure rotator presses against or contacts an outer circumferential surface of the fixing rotator. The nip formation pad is disposed inside the fixing rotator and disposed opposite an inner circumferential surface of the fixing rotator to press against the pressure rotator via the fixing rotator to form the fixing nip SN between the fixing rotator and the pressure rotator. The heat generator is disposed inside the fixing rotator and disposed opposite the inner circumferential surface of the fixing rotator to heat the fixing rotator. The reflector, disposed inside the fixing rotator and disposed opposite the inner circumferential surface of the fixing rotator, includes a reflection face (e.g., the reflection face 40*f*, 40*f*T, 40*f*U, and 40*f*V) to reflect radiant heat or light radiated from the heat generator toward the fixing rotator. The nip formation pad includes a slide portion (e.g., the pressure pad 60) over which the inner circumferential surface of the fixing rotator slides and a reinforcement (e.g., the stay 61) projecting from the slide portion inward toward an interior of a loop formed by the fixing rotator. The heat generator is disposed opposite the side face 61*a* of the reinforcement. The reflection face of the reflector includes a reflection portion (e.g., the projection 43, the arch 44, the recess 45, and the third plane 46B) disposed opposite the heat generator to reflect the radiant heat or light radiated from the heat generator in a direction not directed to the heat generator. The reflection portion is disposed opposite the heat generator at various angles. The support provided separately from the nip formation pad supports the reflector.

Since the reflector is supported by the support provided separately from the nip formation pad, the reflector is secured to the support separately from the reinforcement of the nip formation pad. Accordingly, even if the nip formation pad is bent inward toward the interior of the loop formed by the fixing rotator by pressure from the pressure rotator, the reflector is not deformed in accordance with bending of the nip formation pad. Consequently, even if the nip formation pad is bent, the reflection portion of the reflector does not deviate from the heat generator, retaining a precise positional relation between the heat generator and the reflector. That is, even if the nip formation pad is bent, the reflection portion of the reflector retains the precise positional relation with the heat generator, thus retaining an improved heating efficiency of the reflection portion of the reflector to heat the fixing rotator.

A description is provided of advantages of the fixing devices 9, 9S, 9T, 9U, and 9V in an aspect B.

In the aspect A, as illustrated in FIGS. 2 and 10, the reflection portion includes a projection (e.g., the projection 43 and the arch 44) that projects from the reflection face toward the heat generator. The support mounts the reflector such that the reflector is interposed between the heat generator and the reinforcement and a center of the heat generator in a direction perpendicular to an axial direction of the fixing rotator is on a hypothetical extension from the projection in a projection direction thereof.

Accordingly, the reflection face reflects radiant heat or light irradiating the reflection face toward the fixing rotator, not toward the heat generator, thus preventing the radiant heat or light from penetrating through the heat generator and preventing the reflected heat or light from heating the heat generator.

A description is provided of advantages of the fixing devices 9, 9S, 9T, 9U, and 9V in an aspect C.

In the aspect A or B, as illustrated in FIG. 2, the reflection portion includes a gable (e.g., the projection 43) that projects from the reflection face toward the heat generator. Accordingly, as radiant heat or light irradiates the slopes 43*a* of the projection disposed opposite the heat generator in an incident direction, the slopes 43*a* reflect the radiant heat or light in a direction different from the incident direction. Thus, the slopes 43*a* of the projection on the reflection face reflect the radiant heat or light toward the fixing rotator, not toward the heat generator, preventing the radiant heat or light from penetrating through the heat generator.

A description is provided of advantages of the fixing devices 9, 9S, 9T, 9U, and 9V in an aspect D.

In the aspect A or B, as illustrated in FIG. 10, the reflection portion includes an arch (e.g., the arch 44) that projects from the reflection face toward the heat generator. Accordingly, as radiant heat or light irradiates a surface of the arch disposed opposite the heat generator in the incident direction, the arch reflects the radiant heat or light in the direction different from the incident direction. Thus, the arch on the reflection face reflects the radiant heat or light toward the fixing rotator, not toward the heat generator, preventing the radiant heat or light from penetrating through the heat generator.

A description is provided of advantages of the fixing devices 9, 9S, 9T, 9U, and 9V in an aspect E.

In the aspect A or B, as illustrated in FIG. 12, the reflector 40V includes the two parallel planes, that is, the first plane 46A and the second plane 46C, that are parallel to the arm 61*c* of the reinforcement. The second plane 46C is stepped with respect to the first plane 46A. The reflection portion includes a tilt plane (e.g., the third plane 46B) that bridges the first plane 46A and the second plane 46C.

Accordingly, as described above, heat or light irradiating the reflection portion on the reflection face that is disposed opposite the heat generator irradiates the tilt plane that is not perpendicular to the incident direction of the heat or light. The tilt plane reflects the heat or light in the direction different from the incident direction, preventing the reflected heat or light from penetrating through the heat generator and therefore directing the reflected heat or light to the fixing rotator.

Additionally, even if the reflector deviates from the heat generator, the heat or light radiated from the heat generator irradiates the tilt plane that is not perpendicular to the incident direction of the heat or light. Accordingly, even if the reflector is displaced with respect to the heat generator, the tilt plane does not direct the heat or light back to the heat generator, preventing the heat or light from being used to heat the heat generator and therefore allowing the heat or light to heat the fixing rotator effectively.

A description is provided of advantages of the fixing devices 9, 9S, 9T, 9U, and 9V in an aspect F.

In any one of the aspects A to E, as illustrated in FIG. 5, the support supports the reinforcement. The support also supports the reinforcement in addition to the reflector, preventing deformation of the reflector in accordance with bending of the reinforcement while suppressing increase in the number of parts of the fixing device.

A description is provided of advantages of the fixing devices 9, 9S, 9T, 9U, and 9V in an aspect G.

In any one of the aspects A to F, as illustrated in FIG. 7, the support also supports the heat generator in addition to the reflector and the reinforcement, achieving precise positioning of the center of the heat generator with respect to the reflection portion of the reflector.

A description is provided of advantages of the fixing devices 9, 9S, 9T, 9U, and 9V in an aspect H.

In any one of the aspects A to G, the reflector is secured to the support with a predetermined interval of about 1 mm between the reflector and the reinforcement. Accordingly, even if the reinforcement is bent, the reflector is not deformed by the bent reinforcement.

A description is provided of advantages of the fixing devices 9, 9S, 9T, 9U, and 9V in an aspect I.

In any one of the aspects A to H, as illustrated in FIGS. 7 and 9, a tension applicator (e.g., the flat spring 72) is anchored to the support and the reflector to apply tension to the reflector outward, that is, from a center to a lateral end of the fixing rotator, in the axial direction (e.g., a longitudinal direction) of the fixing rotator. Accordingly, the reflector is not bent by its weight.

A description is provided of advantages of the fixing devices 9, 9S, 9T, 9U, and 9V in an aspect J.

As illustrated in FIG. 1, an image forming apparatus (e.g., the image forming apparatus 500) includes an image forming device (e.g., the image forming devices 1Y, 1M, 1C, and 1K of the image forming section 200) to form a toner image on a recording medium (e.g., a transfer sheet S) with toner and a fixing device (e.g., the fixing devices 9, 9S, 9T, 9U, and 9V) disposed downstream from the image forming device in a recording medium conveyance direction to fix the toner image on the recording medium under heat and pressure. The fixing device attains any one of the aspects A to I. Accordingly, the fixing device retains heating efficiency of heating the fixing rotator and therefore allows the entire image forming apparatus to save energy.

According to the exemplary embodiments described above, the fixing belt 38 serves as a fixing rotator. Alternatively, a fixing film, a fixing sleeve, or the like may be used as a fixing rotator. Further, the pressure roller 30 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

a nip formation pad disposed inside the fixing rotator;

a pressure rotator to press against the nip formation pad via the fixing rotator to form a fixing nip between the fixing rotator and the pressure rotator;

a heat generator disposed inside the fixing rotator to heat the fixing rotator;

a reflector interposed between the heat generator and the nip formation pad, the reflector including a reflection face to reflect radiant heat radiated from the heat generator, the reflection face including a reflection portion disposed opposite the heat generator at various angles; and a support including a supporting side plate at each end of the reflector which support the reflector, the supporting side plates being separate from the nip formation pad.

2. The fixing device according to claim 1, wherein the nip formation pad includes:

a slide portion over which an inner circumferential surface of the fixing rotator slides; and a reinforcement projecting from the slide portion inward toward an interior of the fixing rotator.

3. The fixing device according to claim 2, wherein the reinforcement includes a side face disposed opposite the heat generator.

4. The fixing device according to claim 2, wherein the reflector further includes:

a first plane parallel to the reinforcement; and a second plane parallel to the reinforcement and stepped with respect to the first plane, and wherein the reflection portion includes a tilt plane bridging the first plane and the second plane.

5. The fixing device according to claim 2, wherein the support supports the reinforcement of the nip formation pad.

6. The fixing device according to claim 2, wherein the reflector is secured to the support with a predetermined interval between the reflector and the reinforcement of the nip formation pad.

7. The fixing device according to claim 2, wherein the reflection portion includes a projection projecting from the reflection face toward the heat generator.

8. The fixing device according to claim 7, wherein the reflector supported by the support is interposed between the heat generator and the reinforcement and a center of the heat generator in a direction perpendicular to an axial direction of the fixing rotator is on a hypothetical extension extending from the projection in a projection direction of the projection.

9. A fixing device comprising:

a fixing rotator rotatable in a predetermined direction of rotation;

a nip formation pad disposed inside the fixing rotator;

a pressure rotator to press against the nip formation pad via the fixing rotator to form a fixing nip between the fixing rotator and the pressure rotator;

a heat generator disposed inside the fixing rotator to heat the fixing rotator;

a reflector interposed between the heat generator and the nip formation pad, the reflector including a reflection face to reflect radiant heat radiated from the heat generator, the reflection face including a reflection portion disposed opposite the heat generator at various angles; and a support being provided separately from the nip formation pad and supporting the reflector, wherein the nip formation pad includes:

a slide portion over which an inner circumferential surface of the fixing rotator slides; and a reinforcement projecting from the slide portion inward toward an interior of the fixing rotator, wherein the reflection portion includes a projection projecting from the reflection face toward the heat generator, and wherein the projection includes a gable projecting from the reflection face toward the heat generator.

10. The fixing device according to claim 9, wherein the support includes a pentagonal slot into which the heat generator is inserted.

11. The fixing device according to claim 10, wherein the slot includes a V-shaped portion disposed opposite and projected toward the gable of the projection of the reflector, the V-shaped portion bearing the heat generator.

12. The fixing device according to claim 11, further comprising a lock pressing the heat generator against the V-shaped portion of the slot.

13. The fixing device according to claim 1, wherein the support supports the heat generator.

14. The fixing device according to claim 1, wherein the reflection portion includes an arch projecting from the reflection face toward the heat generator.

15. The fixing device according to claim 1, wherein the reflection portion includes a recess recessed with respect to the heat generator.

16. The fixing device according to claim 1, further comprising a tension applicator anchored to the support and the reflector to apply tension to the reflector outward in an axial direction of the fixing rotator.

17. The fixing device according to claim 16, wherein the tension applicator includes a flat spring.

18. The fixing device according to claim 17, wherein the flat spring includes:

a first end secured to the support; and a second end inserted into the reflector to define an L-shape with the first end.

19. The fixing device according to claim 1, wherein the reflection portion reflects the radiant heat radiated from the heat generator in a direction not directed to the heat generator.

20. The fixing device according to claim 1, wherein:

each of the side plates includes v-shaped portion including a downward projection, the reflector has an upward projection, and the downward projection of the v-shaped portion is disposed opposite to the upward projection of the reflector.

21. An image forming apparatus comprising:

an image forming device to form a toner image; and a fixing device disposed downstream from the image forming device in a recording medium conveyance direction to fix the toner image on a recording medium, the fixing device including:

a fixing rotator rotatable in a predetermined direction of rotation;

a nip formation pad disposed inside the fixing rotator;

a pressure rotator to press against the nip formation pad via the fixing rotator to form a fixing nip between the fixing rotator and the pressure rotator;

a heat generator disposed inside the fixing rotator to heat the fixing rotator;

a reflector interposed between the heat generator and the nip formation pad, the reflector including a reflection face to reflect radiant heat radiated from the heat generator, the reflection face including a reflection portion disposed opposite the heat generator at various angles; and a support including a supporting side plate at each end of the reflector which support the reflector, the supporting side plates being separate from the nip formation pad.

* * * * *